US005127648A

United States Patent [19]

Mallick

[11] Patent Number: 5,127,648

[45] Date of Patent: Jul. 7, 1992

[54] FOOTBALL WITH FINGER-GRIP POCKET

[76] Inventor: George J. Mallick, 2245 Ocean Ave., San Francisco, Calif. 94127

[21] Appl. No.: 833,779

[22] Filed: Feb. 11, 1992

[51] Int. Cl.[5] ..... A63B 43/02; A63B 41/08

[52] U.S. Cl. ..... 273/65 EG; 273/65 EC; 273/164

[58] Field of Search ..... 273/65 EG, 54 C, 64, 273/65 EC, 65 E, 65 R, 65 EE, 65 EF, 65 F, DIG. 20; D21/204, 205; 40/327

[56] References Cited

U.S. PATENT DOCUMENTS

D. 241,869 10/1976 Hilprecht ..... D21/204
D. 285,230 8/1986 Adams ..... D21/204
1,111,023 9/1914 Hyatt ..... 273/64
2,448,731 9/1948 Park ..... 273/65 EG X
2,941,805 6/1960 Chupa ..... 273/58 C
3,185,476 5/1965 Fechner ..... 273/58 C
3,755,820 9/1973 Petrusek ..... 273/58 C

*Primary Examiner*—George J. Marlo

[57] ABSTRACT

A pocket (33) with a flange (35) and a finger grip bar (39) is glued and sewn into section (21A) of a football (20) such that a player can insert his fingers into the pocket opening (38), against bar (39) thus enabling him to hold onto the ball with more firmness, or throw and spin the ball with added accuracy.

5 Claims, 3 Drawing Sheets

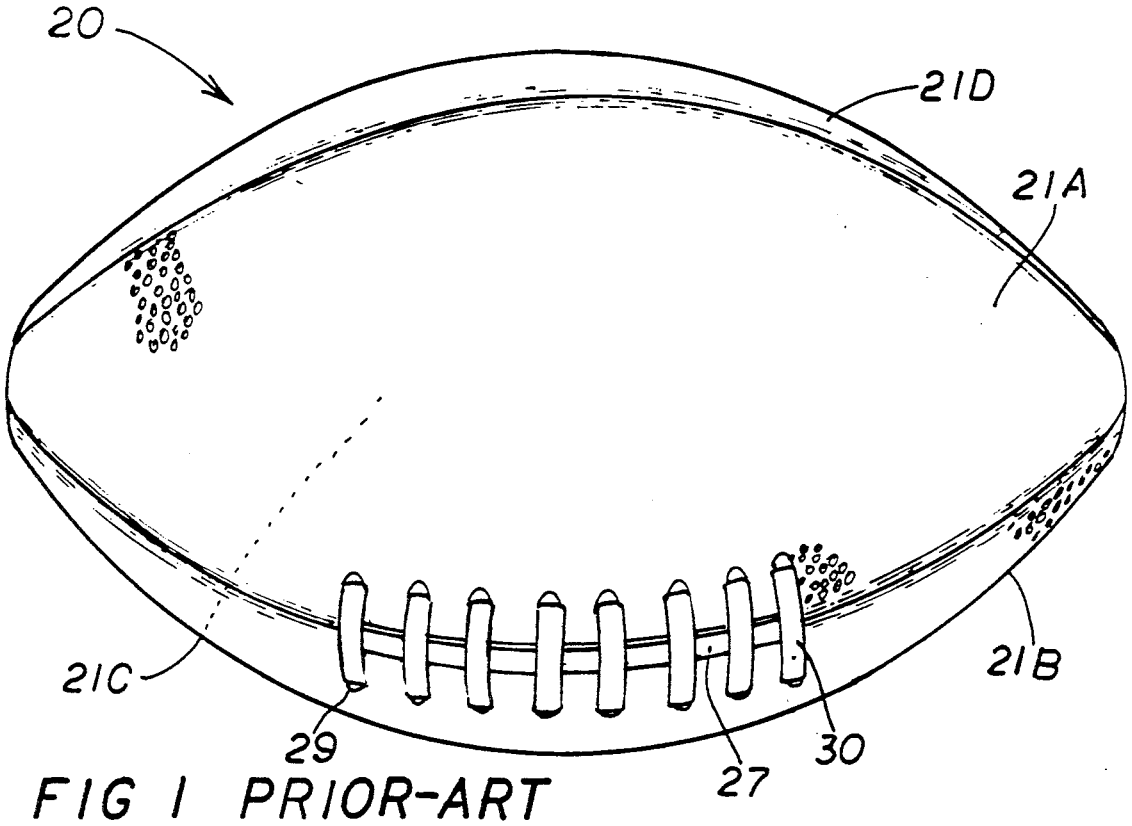
FIG 1 PRIOR-ART
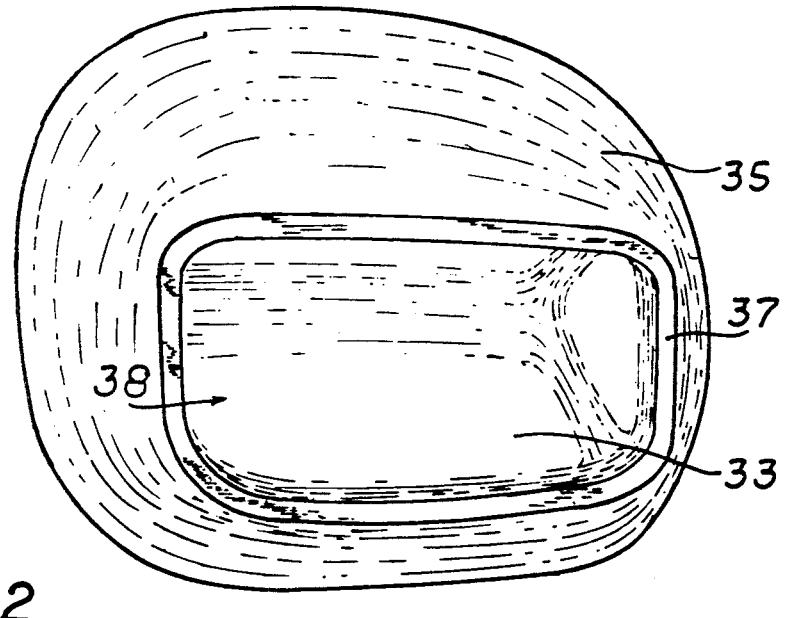
FIG 2

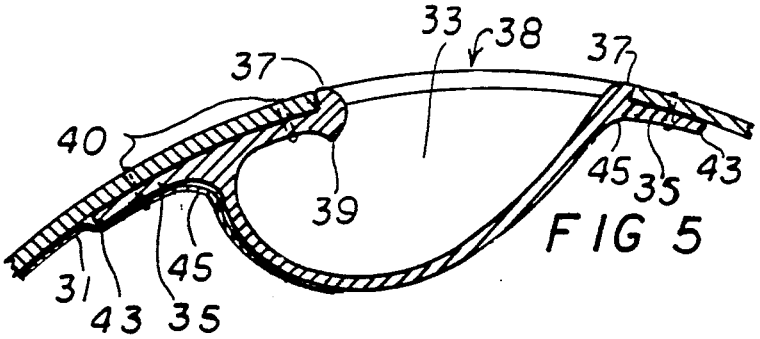
FIG 5
FIG 4
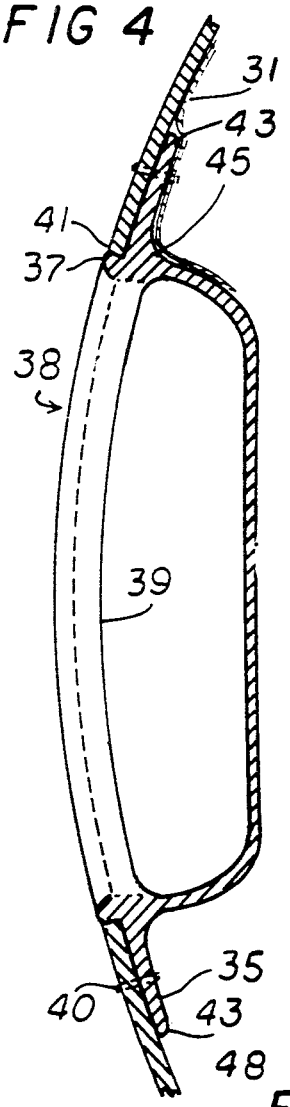
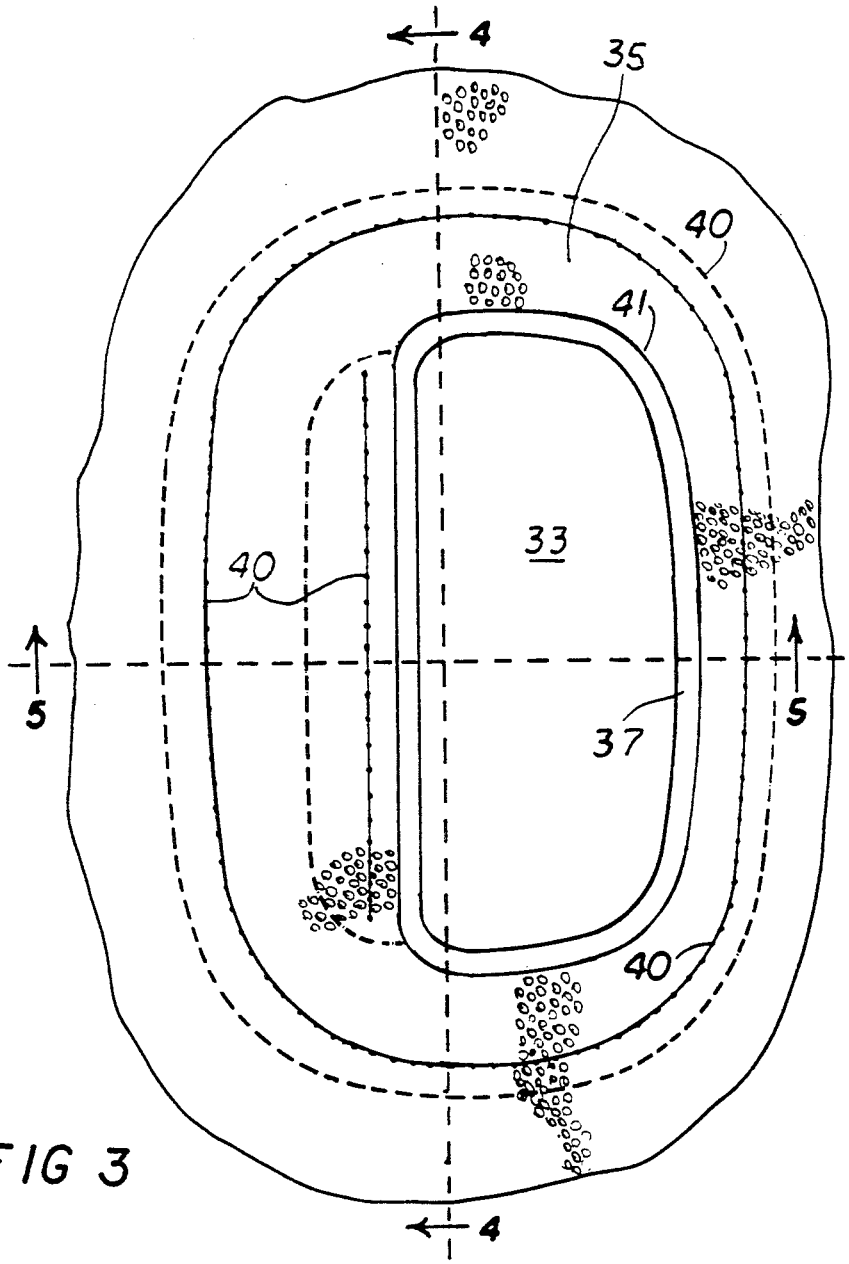
FIG 3

FOOTBALL WITH FINGER-GRIP POCKET

BACKGROUND

1. Field of Invention

The present invention relates to footballs, in particular to a means for gripping the ball when holding onto or throwing it.

2. Description of Prior-Art

In American Football, spinning the ball is essential for sending the ball into straight flight and making maximum use of the aerodynamics provided by the pointed ends of the ball. In the past, footballs came with no specific means to help a player grip and spin a ball when throwing it. A player with large hands can extend his fingers well around the circumference of the ball and get a wide grip, permitting him to spin the ball effectively. A player with smaller hands can not get as good a grip, putting him at a distinct disadvantage.

Also, many games are lost when a player drops the ball after catching it, or when a player on the other team knocks the ball out of his hands. This happens because the shape, size, and relatively smooth surface texture of footballs make them very hard to hold.

Additionally, football games are played in a wide variety of climates, from very warm to very cold, and under such extreme and varied weather conditions as snow, high wind, extreme humidity, mud, and heavy rain. Such conditions add to the difficulty of handling the ball; wet weather, expecially, makes for a slippery ball, which even the best player may have trouble gripping or throwing. Football is also a rough game, in which players have very little time to throw or catch a ball before being knocked down.

R. B. Henderson in U.S. Pat. No. 3,508,750, dated Apr. 28, 1970, shows a game ball in which hand-sewn seams produce inwardly projecting grooves along the seams. The problem with this approach is that it does not produce sufficient grip for the fingers to throw and also spin the ball.

D. R. Kralik, in U.S. Pat. No. 4,660,831, dated Apr. 28, 1987, shows a ball in which extra padding under the outer cover allows an improved grip when holding and throwing the ball, although not sufficient to allow for maximum control of the ball. Other patents of general interest include U.S. Pat. Nos. 1,603,513 and 2,129,238.

OBJECTS AND ADVANTAGES

Accordingly, one object and advantage of the present invention is to provide means for a player to grip and hold onto the ball securely enough to prevent an opponent from knocking the ball from his grip. Another object and advantage is to provide an opportunity for a player to position his grip to allow for an accurate spin on the ball when he throws it to another player. Still further objects and advantages are to provide a football which is easier to grasp, hold, and throw, despite frequent contact with ground which is wet or slippery, due to ice, snow, mud, or rain.

Further objects and advantages will become apparent from a consideration of the ensuing description taken in conjunction with the accompanying drawings.

BRIEF DESCRIPTION OF DRAWINGS

FIG. 1 is a perspective view of a football of prior-art.

FIG. 2 is a perspective view of a plastic pocket for fitting to a football of the type shown in FIG. 1, according to the invention.

FIG. 3 is a fragmented top view of a pocket fitted to a football.

FIG. 4 is a sectional view taken along the line 4—4 of FIG. 3.

FIG. 5 is a sectional view taken along the line 5—5 of FIG. 3.

REFERENCE NUMERALS

Figure 6:
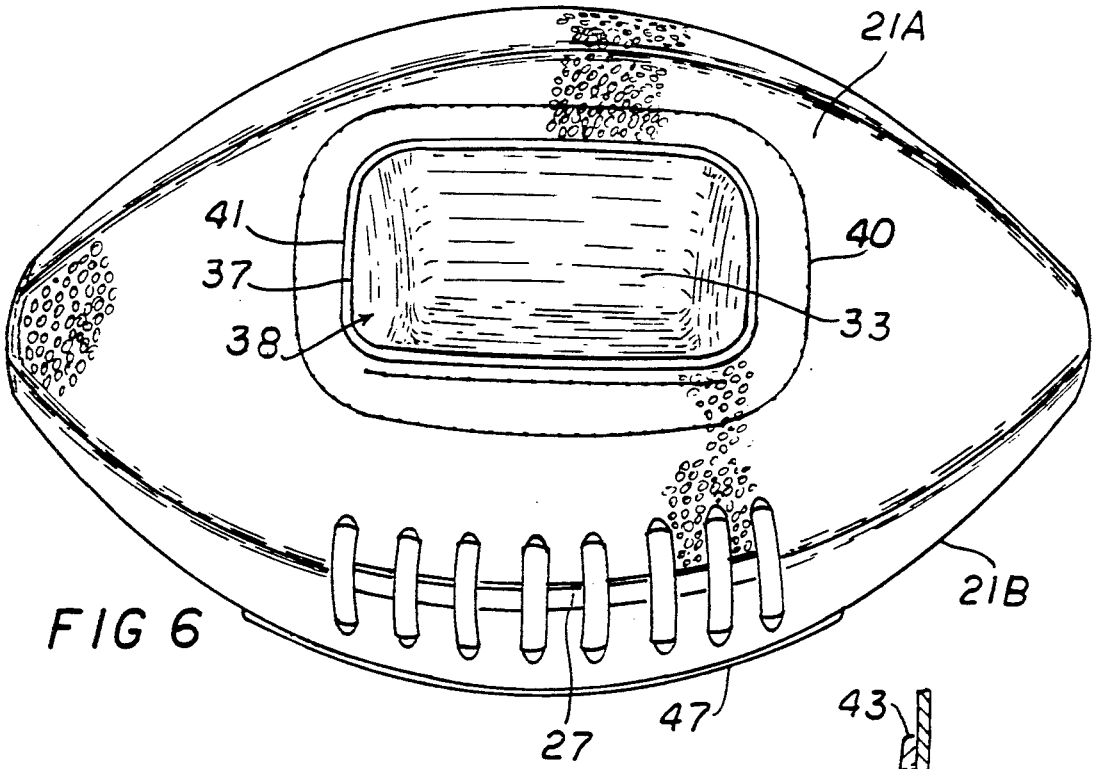
FIG. 6 is a perspective view of a football fitted with a finger grip pocket according to the invention.

20 prior art football
21A–21D sections
23 edges
25 sewing
27 short section
29 pairs of holes
30 lace
31 bladder
33 pocket
35 edge flange
37 projecting rim
38 opening
39 finger grip
40 stitching
41 edge
43 inside edge
45 corners
47 elongated strip
48 interior surface
49 outer surface

PRIOR-ART FOOTBALL—FIG. 1

FIG. 1 shows a Prior-art football 20, which comprises four separate sections of leather 21A–21D. Each section is joined along its edges 23, by sewing 25, (best seen in FIG. 7). A short section 27 about 11 cm (4") long is not sewn, but is provided with pairs of holes 29, for lacing together with lace 30. An air tube or bladder 31 (FIGS. 4 and 5) of similar shape to the football's outside shape, is placed inside the ball and inflated with air through a valve (not shown).

DETAILED DESCRIPTION OF PREFERRED EMBODIMENT—FIGS. 2–7

The present invention is fitted to a prior-art football, and provides a means for a player to easily hold, throw, and spin a ball to another player.

FIG. 2 shows a pocket 33 made of fiberglass, comprising an edge flange 35, a projecting rim 37, an opening 38 and a finger grip bar 39 (FIGS. 2–5, and 7).

After cutting a hole in cover section 21A, pocket 33 is glued and sewn by stitching 40 through flange 35 to interior surface 48 of cover section 21A of football 20, (FIG. 6). Rim 37 is provided as protection for leather edge 41 of section 21A which closely surrounds rim 37. Inside edges 43 and corners 45 are all contoured to provide protection against damage to bladder 31 when the ball is inflated with air, (FIGS. 4 and 5).

In addition, an elongated strip 47 of leather or rubber, is adhesively attached along outer surface 49 of section 21B of the football to provide a gripping bar for the players thumb.

Figure 7:
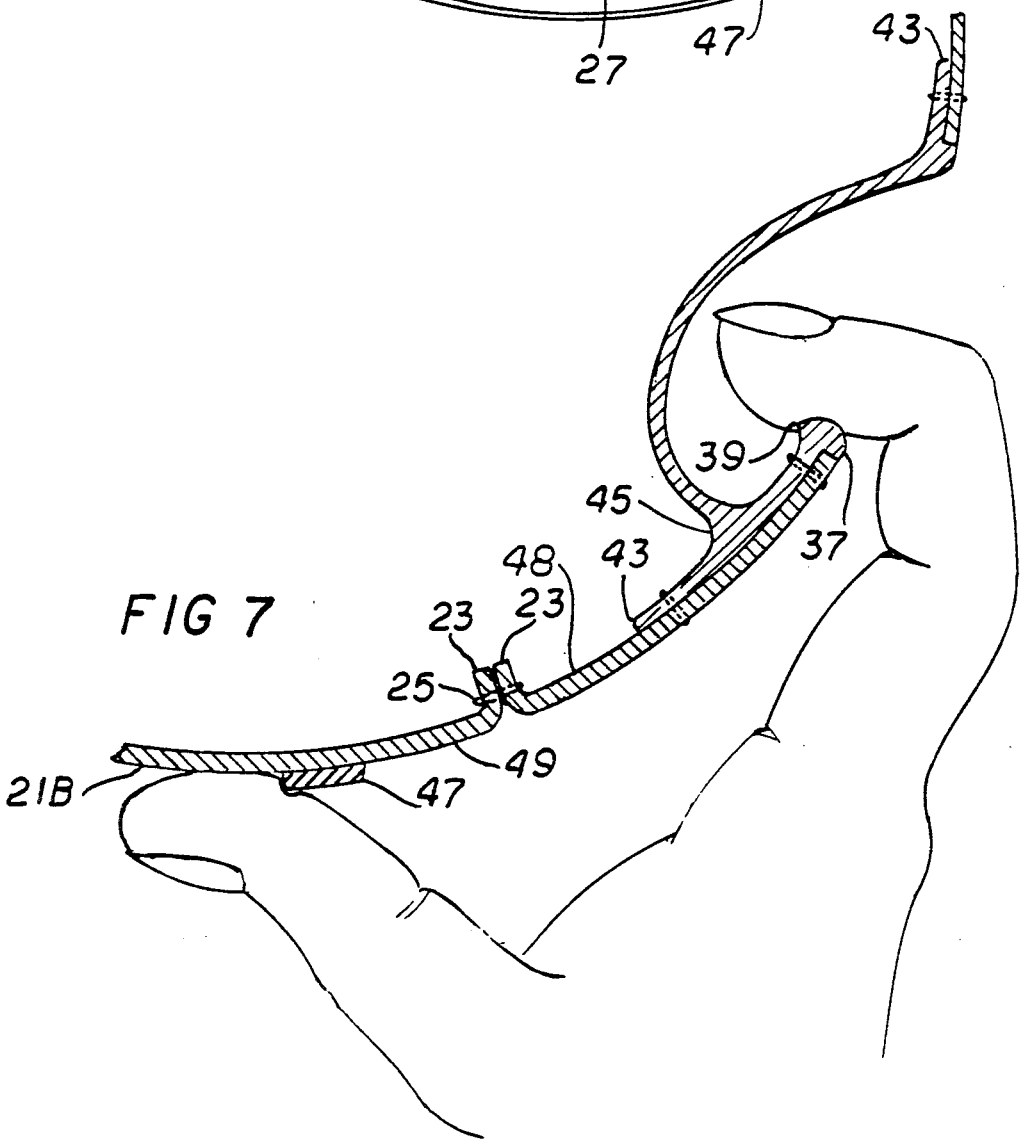
FIG. 7 is a sectional view of a portion of the ball and finger-grip pocket showing a hand gripping the ball prior to throwing.

FIG. 7 shows a sectioned view of pocket 33, and strip 47 fitted to a football with a player's hand shown in position to throw and spin the ball.

Pocket 33 is about 9 cm (3.5") wide, and 23 mm (0.875") deep, and can be made of fiberglass, plastics, or any other suitable material.

SUMMARY, RAMIFICATIONS AND SCOPE

Thus the reader will see that I have provided an improvement to a football which will enable a player to grasp and hold the ball more easily, particularly when an opponent attempts to knock the ball from the player's grasp. Also, I have provided a means to grasp and spin the ball when throwing it to another player, as well as to enable players with small hands to spin a ball when throwing as effectively as players with larger hands.

While the above description contains many specificities, the reader should not construe these as limitations on the scope of the invention, but merely as exemplifications of preferred embodiments thereof. Those skilled in the art will envision that many other possible variations are within its scope. For example, skilled artisans will readily be able to change the dimensions and shapes of the embodiments, such as by making the pocket wider or narrower, or deeper, or shallower or providing different shapes to the pocket and enlarging or decreasing the size and shape of the gripping bar, or using different materials, or methods of attaching, or even alternative positioning of the pocket in the ball, such as placing it at an angle, or nearer to one end of the ball, or even making two pockets, or numerous pockets of different sizes and placing them in various places and sections around the ball.

Accordingly, the reader is requested to determine the scope of the invention by the appended claims and their legal equivalents, and not by the examples which have been given.

What is claimed is:

1. In a game ball for throwing, said ball having a cover with an interior surface, the cover of the ball defining an opening therein, the opening having a circular edge, the improvement of a means for grasping the ball, comprising:

a rigid, circular flange having a convex surface conforming to, and in contact with, the interior surface of the cover which encircles and is immediately adjacent the circular edge of said opening;

a pocket formed as a concave well inward of the flange, the pocket having dimensions sufficient to accept up to four finger tips of a player's hand to facilitate throwing the ball with a spin in a game;

the cover affixed to the flange such that the flange is immovablely secured to the cover, the pocket being positioned at the center of the opening in the cover for access thereto.

2. The grasping means of claim 1 further including a finger grip bar extending from one side of the pocket as an extension of the convex surface, the bar overlying a portion of the pocket, such that the finger tips may be inserted into the pocket and folded around the bar for improved gripping of the ball.

3. The grasping means of claim 2 wherein the finger grip bar has an enlarged edge for improved finger gripping.

4. The improvement of claim 2 further including an elongated strip of flexible material, the strip fastened to the outer surface of the cover in a position parallel to the finger grip bar such that when the finger tips are in contact with the bar, the associated thumb may be placed over the strip, the strip and the bar providing opposing clamping surfaces for improved gripping of the ball.

5. The grasping means of claim 1 further including a projecting rim extending around the pocket, the rim projecting above the convex surface by an amount approximately equal to the thickness of the cover, the edge of the opening in the cover abutting the rim.

* * * * *